US012751519B2

(12) United States Patent
Bell et al.

(10) Patent No.: US 12,751,519 B2
(45) **Date of Patent: *Oct. 6, 2026**

(54) ARTICLE OF FOOTWEAR HAVING A SKIN LAYER BETWEEN A KNITTED COMPONENT AND A SOLE STRUCTURE

(71) Applicant: NIKE, Inc., Beaverton, OR (US)

(72) Inventors: Torrey J. Bell, Portland, OR (US); Lauren Tyndall, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/272,302

(22) Filed: Jul. 17, 2025

(65) Prior Publication Data

US 2025/0338916 A1 Nov. 6, 2025

Related U.S. Application Data

(63) Continuation of application No. 18/540,304, filed on Dec. 14, 2023, now Pat. No. 12,383,022, which is a continuation of application No. 17/388,324, filed on Jul. 29, 2021, now Pat. No. 11,882,897, which is a continuation of application No. 16/361,978, filed on Mar. 22, 2019, now Pat. No. 11,109,641.

(51) Int. Cl.

| | |
|---|---|
| ***A43B 13/12*** | (2006.01) |
| ***A43B 13/04*** | (2006.01) |
| ***A43B 13/32*** | (2006.01) |
| ***A43B 23/02*** | (2006.01) |

(52) U.S. Cl.

CPC ..... *A43B 13/125* (2013.01); *A43B 13/04* (2013.01); *A43B 13/12* (2013.01); *A43B 13/32* (2013.01); *A43B 23/0255* (2013.01); *A43B 23/026* (2013.01); *D10B 2501/043* (2013.01)

(58) Field of Classification Search

CPC ..... A43B 13/04; A43B 13/12; A43B 23/0255; A43B 23/026; D10B 2501/043

See application file for complete search history.

(56) References Cited

U.S. PATENT DOCUMENTS

| | | | | |
|---|---|---|---|---|
| 5,983,524 | A | 11/1999 | Polegato | |
| 8,595,878 | B2 | 12/2013 | Huffa et al. | |
| 11,109,641 | B2 | 9/2021 | Bell et al. | |
| 11,882,897 | B2 | 1/2024 | Bell et al. | |
| 2002/0078591 | A1* | 6/2002 | Morrone | A43B 5/12 36/102 |

(Continued)

FOREIGN PATENT DOCUMENTS

| | | | |
|---|---|---|---|
| CN | 102076234 | A | 5/2011 |
| CN | 102137600 | A | 7/2011 |

(Continued)

*Primary Examiner* — Ted Kavanaugh

(74) *Attorney, Agent, or Firm* — Shook, Hardy & Bacon L.L.P.

(57) ABSTRACT

An article of footwear may have a knitted component with an overfoot portion and an underfoot portion. At least one sole structure may be secured to the underfoot portion of the knitted component. A first knit surface of the underfoot portion may face toward a foot-receiving void, while a second knit surface may comprise a first thermoplastic material. A skin layer may be located between and directly coupled to the sole structure and the second knit surface.

38 Claims, 4 Drawing Sheets

(56) References Cited

U.S. PATENT DOCUMENTS

| | | | | |
|---|---|---|---|---|
| 2008/0263897 | A1* | 10/2008 | Shepherd | A43C 11/1493 36/114 |
| 2010/0077634 | A1 | 4/2010 | Bell | |
| 2011/0113655 | A1 | 5/2011 | Polegato Moretti | |
| 2012/0055042 | A1 | 3/2012 | Polegato Moretti | |
| 2012/0279260 | A1 | 11/2012 | Dua et al. | |
| 2013/0067639 | A1 | 3/2013 | Dua et al. | |
| 2016/0136910 | A1* | 5/2016 | Krajcir | A43B 13/04 12/146 B |
| 2017/0245582 | A1 | 8/2017 | Green et al. | |
| 2017/0311672 | A1 | 11/2017 | Hipp et al. | |
| 2018/0303203 | A1 | 10/2018 | Constantinou | |
| 2018/0317592 | A1 | 11/2018 | Rudolf et al. | |
| 2018/0346776 | A1 | 12/2018 | Park | |
| 2019/0037967 | A1 | 2/2019 | Mcfarland, II et al. | |
| 2020/0048800 | A1 | 2/2020 | Mcfarland et al. | |
| 2020/0297069 | A1 | 9/2020 | Bell et al. | |
| 2020/0375317 | A1 | 12/2020 | Meir | |

FOREIGN PATENT DOCUMENTS

| | | | |
|---|---|---|---|
| WO | 2007/148365 | A1 | 12/2007 |
| WO | 2015/126613 | A1 | 8/2015 |
| WO | 2017/208273 | A1 | 12/2017 |

* cited by examiner

ARTICLE OF FOOTWEAR HAVING A SKIN LAYER BETWEEN A KNITTED COMPONENT AND A SOLE STRUCTURE

CROSS-REFERENCE TO RELATED APPLICATIONS

This application, titled "Article of Footwear Having a Skin Layer Between a Knitted Component and A Sole Structure," is a continuation of U.S. application Ser. No. 18/540,304 and titled "Article of Footwear Having a Skin Layer Between a Knitted Component and A Sole Structure," which is a continuation of U.S. application Ser. No. 17/388,324, filed Jul. 29, 2021 and titled "Article of Footwear Having a Skin Layer Between a Knitted Component and A Sole Structure," now U.S. Pat. No. 11,882,897, which is a continuation of U.S. application Ser. No. 16/361,978, filed Mar. 22, 2019, now U.S. Pat. No. 11,109,641, and titled "Article of Footwear Having a Skin Layer Between a Knitted Component and A Sole Structure." These applications are incorporated herein by reference in their entirety.

BACKGROUND

Conventional articles of footwear generally include two primary elements: an upper and a sole structure. The upper is generally secured to the sole structure and may form a void within the article of footwear for comfortably and securely receiving a foot. The sole structure is generally secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and may form a ground-engaging portion of the sole structure that is formed from a durable and wear-resistant material.

The upper of the article of footwear generally extends over the instep and toe areas of the foot, along the medial and lateral sides of the foot, and around the heel area of the foot. Access to the void on the interior of the upper is generally provided by an ankle opening in a heel region of the footwear. A lacing system is often incorporated into the upper to adjust the fit of the upper, thereby facilitating entry and removal of the foot from the void within the upper. In addition, the upper may include a tongue that extends under the lacing system to enhance adjustability of the footwear, and the upper may incorporate a heel counter to limit movement of the heel.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like-referenced numerals designate corresponding parts throughout the different views.

DETAILED DESCRIPTION

Figure 1:
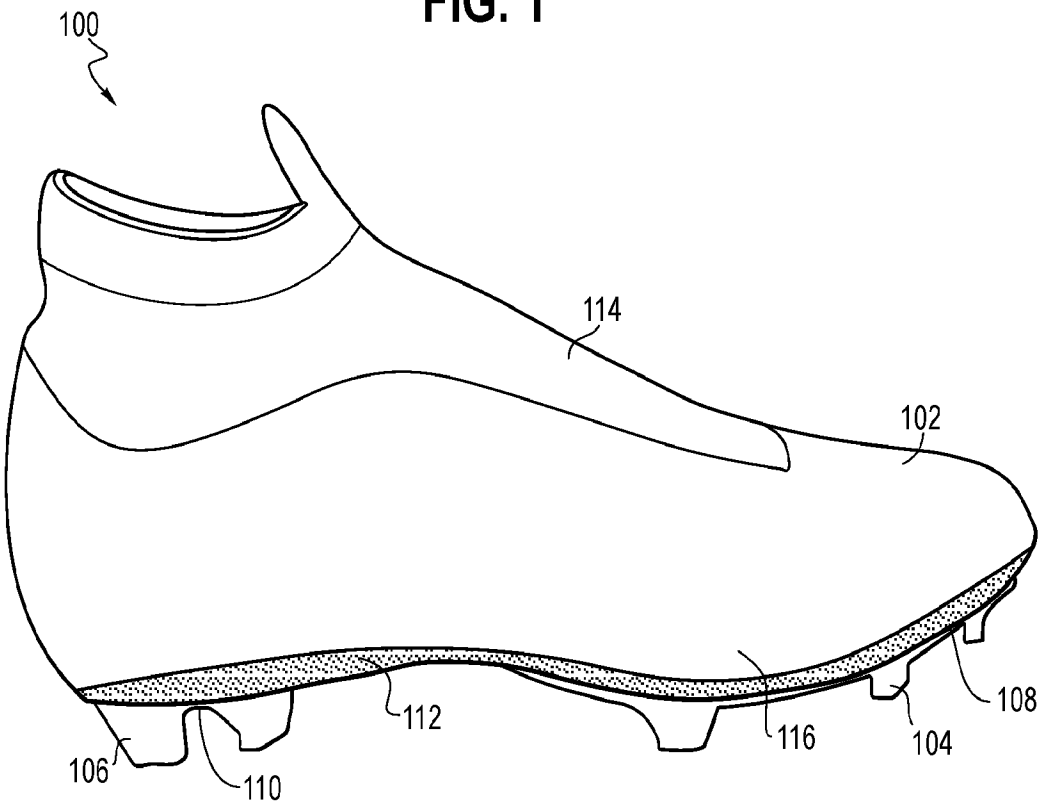
FIG. 1 is an illustration showing a perspective view of an article of footwear including a knitted component, a skin layer, and two sole structures in accordance with certain aspects of the present disclosure.

Various aspects are described below with reference to the drawings in which like elements generally are identified by like numerals. The relationship and functioning of the various elements of the aspects may be better understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

Certain aspects of the present disclosure relate to knitted components configured for use in an article of footwear and/or other articles, such as articles of apparel. When referring to articles of footwear, the disclosure may describe basketball shoes, running shoes, biking shoes, cross-training shoes, football shoes, golf shoes, hiking shoes and boots, ski and snowboarding boots, soccer shoes, tennis shoes, and/or walking shoes, as well as footwear styles generally considered non-athletic, including but not limited to dress shoes, loafers, and sandals.

In certain aspects, the present disclosure relates to an article of footwear having a knitted component with an overfoot portion and an underfoot portion. At least one sole structure may be secured to the underfoot portion of the knitted component. A first surface of the underfoot portion, facing away from the at least one sole structure, may be formed as a first knit layer of the knitted component. A second layer of the knitted component, located between the first knit layer and the sole structure, may include a first thermoplastic material having a first melting temperature. A third layer, located between the second layer and the sole structure, may include a second thermoplastic material having a second melting temperature, where the second thermoplastic material is different than the first thermoplastic material. A transition region may be located between the second layer and the third layer, where the transition region may include a mixture of the first thermoplastic material and the second thermoplastic material and secures the second layer to the third layer.

In another aspect, an article of footwear may include a knitted component having an overfoot portion and an underfoot portion and a sole structure secured to the underfoot portion, where at least a portion of the underfoot portion of the knitted component includes a first knit surface and a second knit surface. The first knit surface may face a void of the article of footwear and the second knit surface may face the sole structure. The second knit surface may include a first thermoplastic material having a melting temperature of about 140 degrees Celsius or less. A skin layer may also be included, where the skin layer has a second thermoplastic material with a melting temperature of about 180 degrees Celsius or less, where the skin layer contacts the second knit surface, and where the skin layer is located between the second knit surface and the sole structure.

In another aspect, an article of footwear may be included that has a knitted component having an overfoot portion and an underfoot portion, a sole structure secured to the underfoot portion, and a skin layer located between a second layer of the underfoot portion and the sole structure. The skin layer may directly attach to the second layer and the sole structure. The knitted component may include a first knit layer and a second layer. The second layer may include a first thermoplastic material. The second layer of the knitted component may have a first thickness, and the skin layer may have a second thickness, where the first thickness is at least 100% greater than the second thickness.

FIG. 1 is an illustration showing an article of footwear 100 in accordance with certain aspects of the present disclosure. As shown, the article of footwear 100 includes a knitted component 102 secured to at least one sole structure (and in this case, a first sole plate 104 and a second sole plate 106). A first biteline 108 may be located where an edge of the first sole plate 104 joins the knitted component 102 and a second biteline 110 may be located where an edge of the second sole plate 106 joins the knitted component 102. As described in more detail below, a skin layer 112 may be located between the knitted component 102 and at least one of the sole structures.

The knitted component 102 may be formed as an integral one-piece element during a knitting process, such as a weft knitting process (e.g., with a flat knitting machine or circular knitting machine), a warp knitting process, or any other suitable knitting process. That is, the knitting process on the knitting machine may substantially form the knit structure of the knitted component 102 without the need for significant post-knitting processes or steps. Alternatively, two or more portions of the knitted component 102 may be formed separately as distinct integral one-piece elements and then the respective elements are attached.

Forming at least a portion of the article of footwear 100 (such as the majority of the article of footwear 100 other than the sole structures) with the knitted component 102 may provide the article of footwear 100 with advantageous characteristics including, but not limited to, a particular degree of elasticity (for example, as expressed in terms of Young's modulus), breathability, bendability, strength, moisture absorption, weight, abrasion resistance, and/or a combination thereof. These characteristics may be accomplished by selecting a particular single layer or multi-layer knit structure (e.g., a ribbed knit structure, a single jersey knit structure, or a double jersey knit structure), by varying the size and tension of the knit structure, by using one or more yarns formed of a particular material (e.g., a polyester material, a relatively inelastic material, or a relatively elastic material such as spandex), by selecting yarns of a particular size (e.g., denier), and/or a combination thereof. The knitted component 102 may also provide desirable aesthetic characteristics by incorporating yarns having different colors, textures or other visual properties arranged in a particular pattern. The yarns themselves and/or the knit structure formed by one or more of the yarns of the knitted component 102 may be varied at different locations such that the knitted component 102 has two or more portions with different properties (e.g., a portion forming a throat area 114 may be relatively elastic while another portion, such as an area 116 near the bitelines 108, 110 may be relatively inelastic).

In some embodiments, the knitted component 102 may incorporate one or more materials with properties that change in response to a stimulus (e.g., temperature, moisture, electrical current, magnetic field, or light). For example, the knitted component 102 may include yarns formed of at least one thermoplastic material or material composition and/or another thermoplastic material, that transitions from a solid state to a softened or liquid state when subjected to certain temperatures at or above its melting temperature and then transitions back to the solid state when cooled. In other words, the thermoplastic material is capable of softening or melting when heated and returning to a solid state when cooled. The thermoplastic material transitions from a solid state to a softened state when its temperature is increased to a temperature at or above its softening temperature, and a liquid state when its temperature is increased to a temperature at or above its melting temperature. When sufficiently cooled, the thermoplastic material transitions from the softened or liquid state to the solid state. As such, the thermoplastic material may be softened or melted, molded, cooled, re-softened or re-melted, re-molded, and cooled again through multiple cycles. For amorphous thermoplastic polymers, the solid state is understood to be the state above the glass transition temperature of the polymer. The glass transition temperature is the temperature at which an amorphous polymer transitions from a relatively brittle glassy state to a relatively more flexible state. The thermoplastic material can comprise one or more thermoplastic polymers. The thermoplastic polymer can be a thermoplastic homopolymer or a thermoplastic copolymer. Examples of types of thermoplastic polymers commonly used in yarns include thermoplastic polyurethanes (TPUs), thermoplastic polyesters, thermoplastic polyethers, thermoplastic polyamides, and thermoplastic polyolefins, and/or nylon. In addition to the one or more thermoplastic polymers, thermoplastic materials commonly used to form yarns can comprise additional ingredients such as processing aids, antioxidants, flame retardants, dyes, pigments, fillers, light stabilizers, and the like.

The one or more thermoplastic materials may provide the ability to heat-process (e.g., heat and then cool) at least a portion of the knitted component 102 to thereby form an area of bonded or continuous material (herein referred to as a "fused area" that exhibits certain advantageous properties, including a relatively high degree of rigidity, strength, and water resistance, for example). The thermoplastic material provided with the knitted component 102 may additionally and/or alternatively be heat processed such that the knitted component 102 bonds to another object (e.g., the skin layer 112 and/or the sole plates 104, 106). Features and specific embodiments of the knitted component 102 including a thermoplastic material are described in more detail below.

Figure 2C:
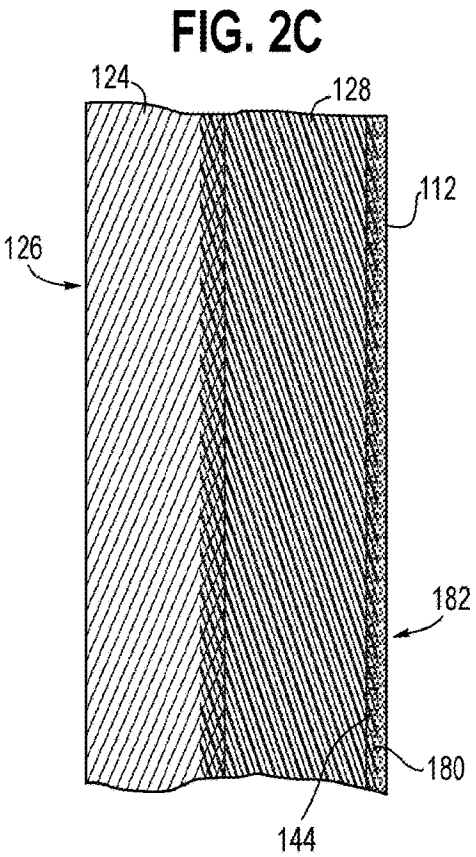
FIG. 2C is an illustration showing a side-view of the multi-layer knit portion of the knitted component of FIG. 2B with the skin layer of FIG. 2B bonded to the second layer of the knitted component, forming a transition region between the second layer of the knitted component and the skin layer in accordance with certain aspects of the present disclosure.
Figure 2B:
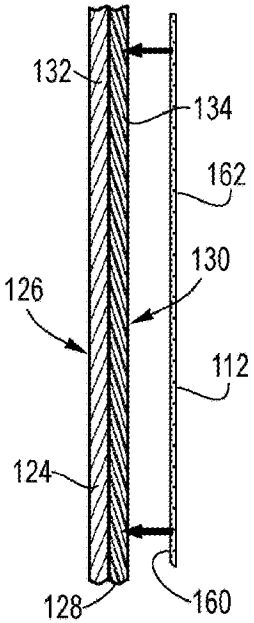
FIG. 2B is an illustration showing a side-view of a multi-layer knit portion of the knitted component of FIGS. 1-2 with a skin layer to be bonded to a second layer of the knitted component in accordance with certain aspects of the present disclosure.
Figure 2A:
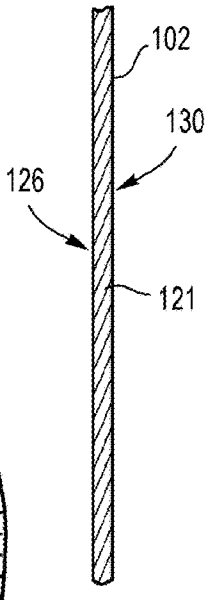
FIG. 2A is an illustration showing a side-view of a single-layer knit portion of the knitted component of FIGS. 1-2 in accordance with certain aspects of the present disclosure.
Figure 2:
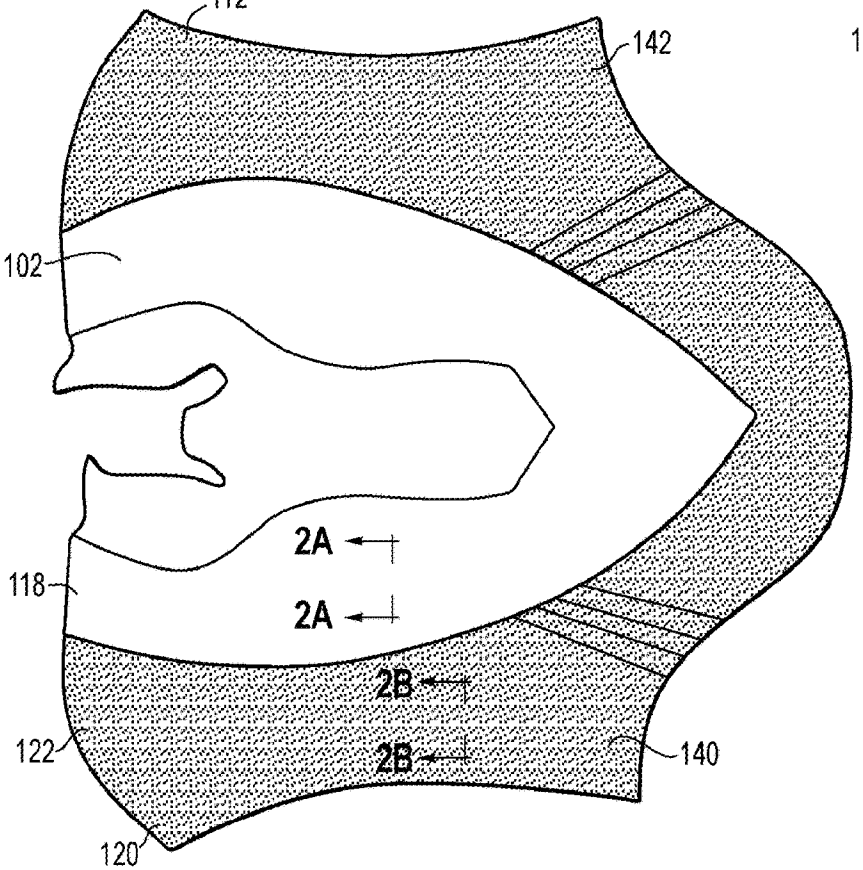
FIG. 2 is an illustration showing the knitted component of FIG. 1 in a post-knitting state in accordance with certain aspects of the present disclosure.

FIG. 2 shows the knitted component 102 as it may appear after the knitting process (e.g., after leaving a flat-bed knitting machine) but before being manipulated into its wearable shape. Optionally, the knitted component 102 may be cut into its desired shape after knitting, but in some embodiments no cutting is required. As shown, the knitted component 102 may include at least one underfoot section, such as a depicted medial underfoot section 140 and a lateral underfoot section 142. The medial underfoot section 140 and the lateral underfoot section 142 may be configured (e.g., sized, shaped, and positioned) to form an underfoot portion 122 of the article of footwear 100. The underfoot portion 122 (shown also in FIG. 4) may be associated with a plantar aspect of the foot (also known as the sole or bottom of a foot). The remainder of the knitted component 102 may be configured to form an overfoot portion 118 associated with the remainder of the foot, including the dorsal surface (i.e., the top of the foot).

Figure 3:
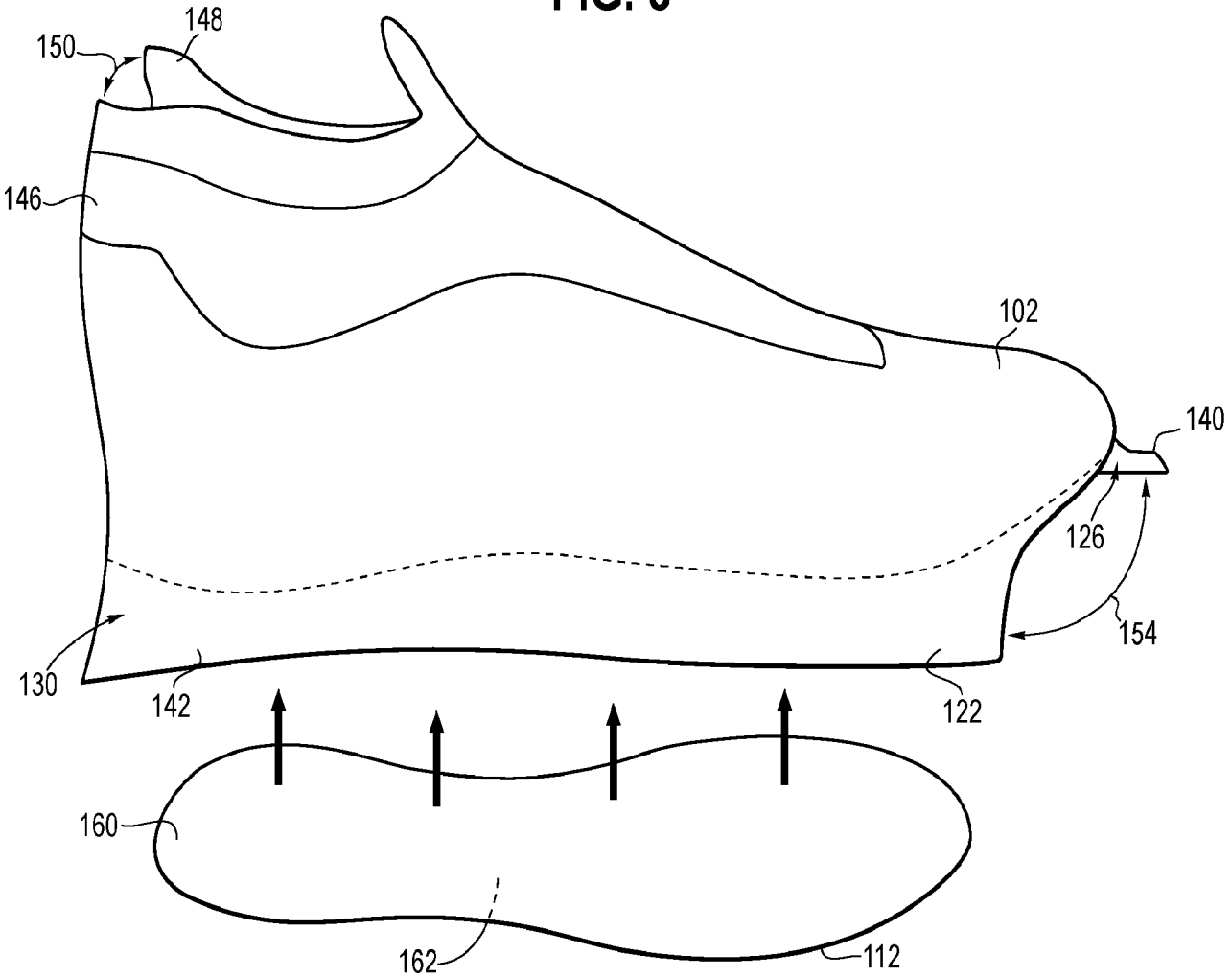
FIG. 3 is an illustration showing a side view of a process for manipulating the knitted component of FIGS. 1-2 into a wearable shape and for applying a skin layer in accordance with certain aspects of the present disclosure.

The skin layer 112 may be located primarily on the peripheral portion 120, thus being primarily located on the underfoot portion 122 when the article of footwear 100 is assembled, and may terminate prior to reaching the overfoot portion 118. Advantageously, the overfoot portion 118 of the knitted component 102 may retain breathability, flexibility and stretchability, and other advantageous characteristics of its knit structure without inhibition by the skin layer 112, while at the same time the skin layer 112 may provide advantageous characteristics to the underfoot portion 122 (such as sufficient bonding to a sole structure and/or waterproofing characteristics, for example). As shown, the skin layer 112 may be applied and attached to the knitted component 102 (e.g., bonded to the knitted component 102 through heat processing) when the knitted component 102 is in a flat state, but alternatively the skin layer 112 may be applied when the knitted component 102 is in a different state (such as a folded orientation and/or a lasted state as shown in FIG. 3).

As depicted by FIGS. 2A and 2B, the knitted component 102 may include different areas with different knit structures. For example, as shown in FIG. 2A, the knitted component 102 may include a single-layer knit structure 121 at a location on the overfoot portion 118 where the surface characteristics of an inner surface 126 and an outer surface 130 are substantially the same. The knit structure of the knitted component 102 may be different at different locations of the overfoot portion 118 to impart zonal characteristics, such as variable elasticity, at selected locations. The overfoot portion 118 is not limited to a single-layer knit structure, and in other embodiments (and/or other locations) a multi-layer knit structure may be included in the overfoot portion 118 to impart advantageous functional characteristics (such as suitable elasticity and/or other structural characteristics) and/or desirable aesthetics. The overfoot portion 118 may include a thermoplastic material that undergoes a change when heat-processed to a certain temperature (described in more detail below), or it may substantially exclude such a material.

Referring to FIG. 2B, the peripheral portion 120 (and perhaps the entire underfoot portion 122) of the knitted component 102 may include a multi-layer knit structure with a first layer (inner knit layer 124) that, when assembled, includes a first surface (inner surface 126) facing the foot-receiving void of the article of footwear along with a second layer (outer knit layer 128) with a second surface (outer surface 130) that defines the exterior surface of the article of footwear. While more than two knit layers may be included in at least some areas of the knitted component 102, only two knit layers are described for simplicity of explanation. As described in more detail below, the outer surface 130 of the outer knit layer 128 may be secured to the skin layer 112. Further, this application hereby incorporates by reference U.S. patent application Ser. No. 15/969,980, filed May 3, 2018, which describes certain examples of knitted components with two-layer knit structures that may be relevant to the present embodiments.

The outer knit layer 128 and the inner knit layer 124 of the knitted component 102 may be separately formed (and then later attached post-knitting) or integrally formed (such that they are coextensive immediately after formation on the knitting machine). For example, in some embodiments, the outer knit layer 128 and the inner knit layer 124 may be formed during a single knitting process (e.g., simultaneously on a knitting machine), such as a knitting process where the two layers are formed on a flat knitting machine with two respective needle beds. The outer knit layer 128 may be primarily formed on a front needle bed, and the inner knit layer 124 may be primarily formed on a back needle bed (or vice versa). In some embodiments, the outer knit layer 128 and the inner knit layer 124 may be separable such that a pocket is formed therebetween, but this is not required. For example, separable layers may be formed by a tubular knitting process where the yarns forming the outer knit layer 128 are knitted only on one bed of the knitting machine and the yarns of the inner knit layer 124 are knitted only on a second bed of the knitting machine. Non-separable layers may be secured via including tie stitches extending from one bed to another throughout the multi-layer portion of the knitted component such that, after knitting, the outer knit layer 128 and the inner knit layer 124 are substantially fixed to each other.

The inner surface 126 and the outer surface 130 may have different characteristics. For example, the inner knit layer 124 may be formed primarily of a first yarn 132, and the first yarn 132 may be specifically selected to provide the inner surface 126 with comfort-related characteristics such as softness, compressibility, etc. (since the inner surface 126 may face a foot when the article of footwear is in use). In some embodiments, the inner knit layer 124 may be primarily formed of polyester, which is known for softness, anti-abrasiveness, and other comfort-related properties.

The outer knit layer 128 of the knitted component 102 may be formed primarily with a second yarn 134, which may be a yarn of a different type than the first yarn 132 (and, in some embodiments, the second yarn 134 may form the outer surface 130 of the overfoot portion 118 as shown in FIG. 2B). In some embodiments, the second yarn 134 includes one or more thermoplastic materials such that the outer knit layer 128 undergoes change when heat processed. When a thermoplastic material or composition is included with a yarn, any portion of the yarn may have one or more thermoplastic polymers (collectively "the thermoplastic material composition"), and in some embodiments, substantially the entirety of the yarn may be formed of the thermoplastic material composition. Optionally, a yarn may have a polyester core and a thermoplastic polymer sheath. If such a yarn is used, the thermoplastic material composition of the sheath may have a melting temperature less than the melting temperature or decomposition temperature of the polyester core. For example, the melting temperature of the thermoplastic material composition may have a melting temperature of approximately 100 degrees Celsius less than the melting temperature of the polyester core in some embodiments, though any other suitable difference in melting temperatures is contemplated. All melting temperatures and other temperatures referenced herein are approximate, and based on atmospheric pressure at sea level. In one example, the melting temperature of the polyester core may be about 260 degrees Celsius, and the decomposition temperature may be about 350 degrees Celsius or greater.

When a yarn with a thermoplastic material is used, the melting temperature of the thermoplastic material (e.g., a thermoplastic polyurethane in some examples) may be between about 80 degrees Celsius and about 200 degrees Celsius, such as from about 120 degrees Celsius to about 180 degrees Celsius, and such as about 140 degrees Celsius in some exemplary embodiments. For example, the thermoplastic material used may have a melting temperature of about 140 degrees C. or less when determined in accordance with ASTM D3418-97, and includes all subranges therein in increments of 1 degree. These temperatures may be suitable for heat-processing procedures that do not burn, scorch, melt, or otherwise compromise other materials in the knitted component when it is heated to the heat-processing temperature. As such, the outer knit layer 128 may be at least partially melted, molded, cooled, re-melted, remolded, and cooled through one or multiple cycles. In an exemplary embodiment, the yarn may include a thermoplastic polyurethane, which may be specifically marketed as a Dream-Sil® thermoplastic polyurethane coated yarn manufactured by Sambu Fine Chemical Co., LTD. Although many thermoplastic materials may be utilized for the second yarn 134 of the outer knit layer 128, an advantage to utilizing thermoplastic polyurethane relates to thermal bonding and colorability. For example, thermoplastic polyurethane is relatively easy to bond with other elements (such as the skin layer 112 shown in FIG. 2C), and colorants may be added to thermoplastic polyurethane through various conventional processes.

As utilized herein, the term "thermal bonding" or variants thereof is defined as a securing technique between two components that involves a softening or melting of a thermoplastic polymer material within at least one of the components such that the components are secured to each other when cooled. Similarly, the term "thermal bond" or variants thereof is defined as the bond, link, or structure that joins two components through a process that involves a softening or melting of a thermoplastic polymer material within at least one of the components such that the components are secured to each other when cooled.

As general examples, thermal bonding may involve (a) the melting or softening of thermoplastic polymer materials within two components such that the thermoplastic polymer materials intermingle with each other (e.g., diffuse across a boundary layer between the thermoplastic polymer materials) and are secured together when cooled; (b) the melting or softening of a thermoplastic polymer material within a first component such that the thermoplastic polymer material extends into or infiltrates the structure of a second component to secure the components together when cooled; and (c) the melting or softening of a thermoplastic polymer material within a first component such that the thermoplastic polymer material extends into or infiltrates crevices or cavities of a second component to secure the components together when cooled. Some example of thermal bonds are described in U.S. patent application Ser. No. 12/367,274, filed Feb. 6, 2009, and published as U.S. Patent Application Publication No. 2013/0067639, which is hereby incorporated by reference in its entirety. Additional examples are described in U.S. patent application Ser. No. 13/100,689, filed May 4, 2011, and published as U.S. Patent Application Publication No. 2012/0279260, which is hereby incorporated by reference in its entirety. As such, thermal bonding may occur when two components include thermoplastic polymer materials or when only one of the components includes a thermoplastic polymer material. Additionally, thermal bonding does not generally involve the use of stitching, adhesives, or other joining techniques, but involves directly bonding components to each other with a thermoplastic polymer material. In some situations, however, stitching, adhesives, or other joining techniques may be utilized to supplement the thermal bond or the joining of components through thermal bonding.

More specific examples of thermal bonding that relate to a knitted component will now be discussed. In general, a bonded component may be any element that is joined with a knitted component, including textile elements (e.g., knit textiles, woven textiles, non-woven textiles), polymer sheets, polymer foam layers, leather or rubber elements, and plates, for example. In a configuration where the bonded component is formed from a textile element, thermal bonding may involve the melting or softening of a thermoplastic polymer material within the knitted component, such that the thermoplastic polymer material extends into the textile element of the bonded component and around individual filaments, fibers, or yarns within the textile element to secure the knitted component and the bonded component together when cooled. In a similar configuration where the bonded component is formed from a textile element incorporating a thermoplastic polymer material, thermal bonding may involve the melting or softening of thermoplastic polymer materials within each of the knitted component and the textile element of the bonded component such that the thermoplastic polymer materials intermingle with each other and are secured together when cooled. Moreover, in any configuration where the bonded component incorporates a thermoplastic polymer material (e.g., textiles, polymer sheets, polymer foam layers, leather or rubber elements, plates), thermal bonding may involve the melting or softening of thermoplastic polymer materials within each of the knitted component and the bonded component such that the thermoplastic polymer materials intermingle with each other and are secured together when cooled. Additionally, in a configuration where the bonded component is a polymer sheet, polymer foam layer, leather or rubber element, or plate, thermal bonding may involve the melting or softening of a thermoplastic polymer material within the knitted component such that the thermoplastic polymer material extends into crevices or cavities of the bonded component to secure the knitted component and the bonded component together when cooled. Although many configurations of the knitted component do not involve the use of stitching, adhesives, or other joining techniques, these joining techniques may be utilized to supplement the thermal bond or the joining of the knitted component and the bonded component through thermal bonding.

FIG. 3 is an illustration showing the knitted component 102 being folded or otherwise manipulated into a wearable shape. As shown, the outer surface 130 formed by the knitted component 102 may face outwards, and the inner surface 126 may face inwards and eventually define the void of the article of footwear. A lateral heel area 146 and a medial heel area 148 may be coupled at this step to form a heel seam 150 in the heel area 152. Connecting the lateral heel area 146 to the medial heel area 148 at the heel seam 150 may include sewing, adhesive bonding, heat bonding, welding, using a mechanical clamp, or any other suitable device or method, and it is contemplated that another device may be placed between the medial heel area 148 and the lateral heel area 146. The folding/manipulating step, and/or the step of forming the heel seam 150, may be at least partially performed when the knitted component 102 is located on a last. An example of a last and an associated lasting process is described in U.S. patent application Ser. No. 12/848,352, filed Aug. 2, 2010, and issued as U.S. Pat. No. 8,595,878, which is hereby incorporated by reference in its entirety.

Similarly, the lateral underfoot section 142 and the medial underfoot section 140 may be coupled at this step to form an underfoot seam 154 on the underfoot portion 122 of the knitted component 102. Connecting the lateral underfoot section 142 to the medial underfoot section 140 may include sewing, adhesive bonding, heat bonding, welding, using a mechanical clamp, or any other suitable device or method, and it is contemplated that another device may be placed between the medial underfoot section 140 and the lateral underfoot section 142. The folding/manipulating step, and/or the step of forming the underfoot seam 154, may be at least partially performed when the knitted component 102 is located on a last (not shown).

Optionally, the skin layer 112 may be secured to a surface of the knitted component 102 prior to shaping and lasting the knitted component 102 (as described above with reference to FIG. 2). However, in the embodiment depicted by FIG. 3, the skin layer 112 may be applied when the knitted component 102 is manipulated substantially into its wearable shape. Advantageously, the skin layer 112 may be provided in one piece and may extend over the underfoot seam 154 (which may enhance the durability of the underfoot seam 154, for example). Further, when the skin layer 112 is used to secure another object to the knitted component 102 (such as a sole structure), a one-piece skin layer 112 may enhance securement of the underfoot portion 122 to a sole structure or another element. Specific embodiments of the skin layer 112 and its related advantages are discussed in more detail below.

Figure 4:
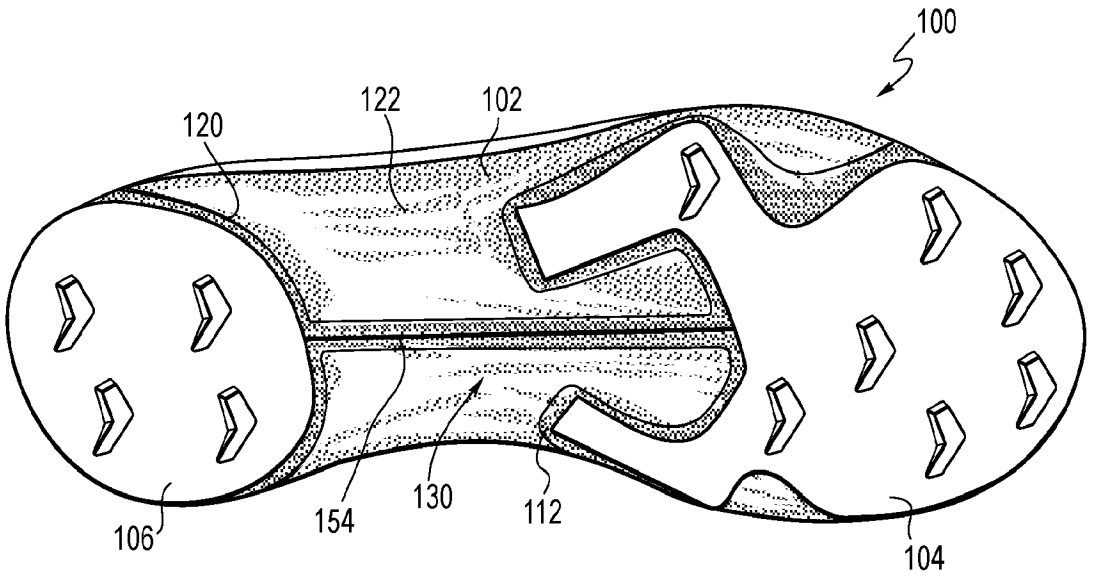
FIG. 4 is an illustration showing a bottom view of the article of footwear of FIG. 1, where the sole structures are secured to the knitted component via the skin layer in accordance with certain aspects of the present disclosure.

FIG. 4 is an illustration showing a bottom view of the article of footwear 100. As shown, the underfoot seam 154 may be located on the underfoot portion 122. The underfoot seam 154 may be approximately in the center of the underfoot portion 122 and may extend along the longitudinal direction of the article of footwear 100, but in other embodiments, the underfoot seam 154 may be offset with respect to the center of the underfoot portion 122 and/or may extend or otherwise be oriented in a different direction.

The underfoot portion 122 may be configured to attach to at least one sole structure (such as the first sole plate 104 and/or the second sole plate 106), either directly (i.e., via direct contact) or indirectly (e.g., through mutual connection to another component or multiple components, such as a skin layer). For example, the underfoot portion 122 may be joined to the first sole plate 104 and/or the second sole plate 106 using any suitable technique, such as through the use of an adhesive, by sewing, bonding, welding, etc.

When the skin layer 112 is included, the sole plates 104, 106 may contact, and be secured to, the skin layer 112 such that the underfoot portion 122 of the knitted component 102 is secured to the sole plates 104, 106 indirectly through the skin layer 112. In other words, the skin layer 112 may be located between the outer knit layer 128 (FIG. 2B) of the underfoot portion 122 and the sole plates 104, 106 when the article of footwear 100 is assembled. Further, the skin layer 112 may be specifically adapted (e.g., via a particular material selection, with particular surface characteristics, etc.) such that it suitably secures to both (1) the underfoot portion 122 of the knitted component 102, and (2) the sole plates 104, 106, particularly when it is difficult or impossible (e.g., due to respective material composition) for the sole plates 104, 106 and knitted component 102 to secure to one another directly. As such, one side (i.e., a first side 160 shown in FIG. 3) of the skin layer 112 may secure to the underfoot portion 122 of the knitted component 102 and a second side (i.e., a second side 162 shown in FIG. 3) may secure to the sole plates 104, 106. The skin layer 112 therefore may include two (or more) separate pieces stuck together (e.g., each piece being formed of a different material), but this is not required. Including the skin layer 112 for bonding purposes may be particularly advantageous when using multiple smaller sole structures relative to typical articles of footwear since available surface area for bonding on the smaller sole structures is relatively reduced. Further, using the skin layer 112 is particularly advantageous when knitting with an "open-mesh" or low-density knit (e.g., where the surface area includes a relatively high number of discontinuities per unit of surface area), which may otherwise render it difficult to secure to a sole structure without increasing the cost and manufacturing time (e.g., by applying additional adhesives).

The skin layer 112 may have any suitable structure and may be formed of any suitable material. In some embodiments, the skin layer 112 may be a sheet or film of polymer material, a textile material, and/or another suitable material that is pressed to, and heated with, the knitted component 102 (either before or after lasting). In other embodiments, a polymer resin may be sprayed or otherwise applied to the outer knit layer 128 of the underfoot portion 122 of the knitted component 102 to form the skin layer 112. The geometry of skin layer 112 may be similar or identical to the geometry of the peripheral portion 120 (e.g., the multi-layer portion) of the knitted component 102 that includes the outer layer with a thermoplastic material. For example, the geometry of the skin layer 112 may be the same as the geometry of the contour of the peripheral portion 120, but with a slightly larger dimension such that the skin layer 112 forms an outline around the outer perimeter of the peripheral portion 120 (or vice versa). Optionally, the skin layer 112 may also extend along a seam in the underfoot portion (if it exists), which may enhance the seam's structural integrity.

The skin layer 112 may have a material that is selected specifically for providing an adequate connection to the underfoot portion 122 of the knitted component 102 as well as to a top surface (or foot-facing) side of the sole plates 104, 106. For example, referring to FIG. 2B, in some embodiments, the first side 160 of the skin layer 112 may be formed of a material configured to bond (e.g., via a chemical/thermal bond or another means) to a thermoplastic material (through heat-processing or otherwise) of the outer surface 130 of the underfoot portion 122, and the second side 162 may be formed of a material configured to bond to the material forming the top surface of the sole structure. In some embodiments, the skin layer is a continuous material (or continuous composition and/or mixture of materials) such that its first side 160 and second side 162 are substantially the same.

In some embodiments, the skin layer 112 may include a thermoplastic material, such as a thermoplastic polymer material including polyurethane, polyester, polyester polyurethane, polyether polyurethane, and/or nylon, among others. Thermoplastic polymer materials, as discussed above, melt when heated and return to a solid state when cooled. Based upon this property, the thermoplastic polymer material from the skin layer 112 may be utilized to form a thermal bond that joins the first side 160 of the skin layer 112 and the outer surface 130 of the underfoot portion 122 and/or form a thermal bond that joins the second side 162 of the skin layer 112 and the top surface of the sole structure. In certain exemplary embodiments, for example, the skin layer 112 may be substantially or entirely formed with a thermoplastic polyurethane having a melting temperature of between about 80 degrees Celsius and about 200 degrees Celsius, such as from about 120 degrees Celsius to about 180 degrees Celsius, and such as about 180 degrees Celsius in some exemplary embodiments. For example, the thermoplastic material can have a melting temperature of 180 degrees Celsius or less when determined in accordance with ASTM D3418-97, and includes all subranges therein in increments of 1 degree.

Referring to FIGS. 2B-2C, the skin layer 112 may be formed of a material with a higher melting temperature than that of the thermoplastic material included with the knitted component 102, which may be advantageous where heat-processing includes directing heat through the skin layer 112 towards the knitted component 102, and when it is desirable for the skin layer 112 and the knitted component 102 to melt (and then harden) at substantially the same rate (e.g., where the skin layer 112 absorbs some heat and/or acts as an insulator such that heat reaches the knitted component 102 at a lower rate than it reaches the skin layer 112). Further, since scorching or otherwise damaging the yarns of the inner knit layer 124 may be undesirable, suing yarns with a relatively low melting point in the outer knit layer 128 may allow for an appropriate degree of softening/melting with a relatively low risk of damaging the inner knit layer 124. Thus, while any suitable material with any suitable melting temperature may be used, the melting temperature of the thermoplastic material in the skin layer 112 may be at least 10 degrees Celsius higher than the melting temperature of the material within the outer knit layer 128 of the knitted component 102, such as at least 30 degrees Celsius higher, 50 degrees Celsius higher, or more (e.g., about 40 degrees Celsius higher in at least one exemplary embodiment).

With any of these materials (and/or other suitable materials), a variety of structures may be utilized for the skin layer 112, including polymer films, polymer meshes, polymer powders, and/or textile structures (including non-woven textiles), for example. Advantageously, forming the skin layer 112 with one or more thermoplastic materials may allow the skin layer to be welded or thermal bonded to other elements. As such, including thermoplastic material(s) may provide the ability to heat and then cool a portion of the skin layer 112 to thereby bond the skin layer 112 to the knitted component 102, a sole structure (such as the sole plates 104, 106), or both.

If thermal bonding is used to secure the knitted component 102 to the skin layer 112, the process of thermal bonding may involve the melting or softening of the yarns of the outer knit layer 128 (which may include a thermoplastic material yarn as described above), and/or the skin layer 112, such that the thermoplastic material(s) included in at least one of those elements intermingle with materials of the other respective element such that they bond when cooled. Referring to FIG. 2C, in some embodiments, where the thermoplastic materials included in both of the outer surface 130 and the skin layer 112 are secured via thermal bonding, a transition region 144 may be formed between the outer surface 130 and the skin layer 112 to secure the outer surface 130 to the skin layer 112. The transition region may be formed from the thermoplastic materials in both of the outer surface 130 and the skin layer 112. It will be appreciated that the transition region 144 may be formed by a mixture 180 of the thermoplastic materials in the outer surface 130 and the skin layer 112 and/or formed by a chemical bond resulted from chemical reactions occurred between the thermoplastic materials in the outer surface 130 and the skin layer 112. The transition region may have a thickness of 0.1 mm or less (e.g., about 0.05 mm, for example). Within the transition region 144, the ratio of material (by mass) of the thermoplastic material provided by the outer knit layer 128 of the knitted component to the skin layer 112 may be between about 2:1 to about 1:2 (e.g., about 1:1), though any other suitable ratio is also contemplated. Notably, in other embodiments or other regions of the embodiment shown in FIG. 2C, only one of the skin layer 112 and the outer surface 130 of the knitted component 102 needs to melt (or at least partially melt/soften) to bond the elements together (and thus one of those elements could exclude a thermoplastic material altogether), but at least partially melting both elements may enhance the bond.

Similarly, the skin layer 112 may bond to the sole plates 104, 106 via thermal bonding (e.g., via melting of the outer layer 182 (shown in FIG. 2C) of the skin layer 112). For example, the thermoplastic material of the skin layer 112 (if included) may at least partially melt to intermingle with the material and/or surface characteristics of the top surface of the sole plates 104, 106 such that the elements are substantially fixed together when cooled. Alternatively, an adhesive, stitching, or another suitable means may be used to secure the skin layer 112 to the sole plates 104, 106. While the sole plates 104, 106 may typically be applied to the skin layer 112 when the skin layer 112 is located on the knitted component 102, it is contemplated that the skin layer 112 could be applied to the sole plates 104, 106 first. Further, while one continuous skin layer 112 is depicted herein, each sole plate 104, 106 may be associated with a separate skin layer 112.

In some embodiments, the skin layer 112 may be relatively thin (e.g., relative to the knitted component 102), which may be advantageous for reducing the overall weight of the article of footwear, allowing for desirable "feel" (e.g., when used in an athletic shoe, such as a soccer shoe, that may contact another object with a certain degree of precision), allowing suitable breathability, among other advantages. For example, in some embodiments, the skin layer 112 (at least where it is located between the knitted component 102 and a sole structure) may be about 0.2 mm or less thickness (e.g., such as between about 0.1 mm and about 0.05 mm in certain embodiments). Comparatively, the knitted component 102 (e.g., either a multi-layer or single knit structure) may have a thickness of about 0.7 mm or more (such as about 1.5 mm in certain embodiments).

In the present disclosure, the ranges given either in absolute terms or in approximate terms are intended to encompass both, and any definitions used herein are intended to be clarifying and not limiting. Notwithstanding that the numerical ranges and parameters setting forth the broad scope of the present embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

While various embodiments of the present disclosure have been described, the present disclosure is not to be restricted except in light of the attached claims and their equivalents. One skilled in the relevant art will recognize that numerous variations and modifications may be made to the embodiments described above without departing from the scope of the present invention, as defined by the appended claims. Moreover, the advantages described herein are not necessarily the only advantages of the present disclosure and it is not necessarily expected that every embodiment of the present disclosure will achieve all of the advantages described.

We claim:

1. An article of footwear, comprising:

a sole structure; and an upper secured to the sole structure, the upper comprising:

a knitted component, comprising:

an underfoot portion at least partially defining a foot receiving void comprising a first knit surface and a second knit surface, the first knit surface facing towards the foot receiving void and the second knit surface facing towards the sole structure; and a skin layer joined to the second knit surface of the knitted component, wherein a portion of the skin layer is positioned between the second knit surface and the sole structure, and wherein a portion of the skin layer is exposed on the underfoot portion that is not covered by the sole structure and provides waterproofing characteristics to an underfoot portion of the upper.

2. The article of footwear of claim 1, wherein an adhesive joins the skin layer to the knitted component.

3. The article of footwear of claim 1, wherein the knitted component comprises a multi-layer knit structure.

4. The article of footwear of claim 1, wherein the second knit surface comprises a polyester yarn.

5. The article of footwear of claim 1, wherein the second knit surface comprises a thermoplastic yarn.

6. The article of footwear of claim 1, wherein the skin layer comprises a thermoplastic material.

7. The article of footwear of claim 1, wherein the skin layer comprises polyurethane.

8. The article of footwear of claim 1, wherein the skin layer extends outward from a perimeter of the sole structure a distance across the underfoot portion.

9. The article of footwear of claim 1, wherein the skin layer extends around a perimeter of the sole structure.

10. The article of footwear of claim 1, wherein the knitted component comprises a seam on the underfoot portion.

11. The article of footwear of claim 10, wherein the sole structure covers at least a portion of the seam.

12. The article of footwear of claim 10, wherein the skin layer covers at least a portion of the seam.

13. The article of footwear of claim 1, wherein the knitted component comprises a mesh.

14. The article of footwear of claim 1, wherein the article of footwear is a soccer shoe.

15. The article of footwear of claim 1, wherein the article of footwear is a football shoe.

16. An article of footwear, comprising:

a sole structure; and an upper secured to the sole structure, the upper comprising:

a knitted component, comprising:

an underfoot portion comprising a first knit surface and a second knit surface, the second knit surface facing towards the sole structure, wherein a polymer film is joined to the knitted component and a portion of the polymer film is positioned between the second knit surface and the sole structure, and wherein a portion of the polymer film is exposed on the underfoot portion adjacent to the sole structure.

17. The article of footwear of claim 16, wherein an adhesive joins the polymer film to the knitted component.

18. The article of footwear of claim 16, wherein the knitted component comprises a multi-layer knit structure.

19. The article of footwear of claim 16, wherein the second knit surface comprises a polyester yarn.

20. The article of footwear of claim 16, wherein the second knit surface comprises a thermoplastic yarn.

21. The article of footwear of claim 16, wherein the polymer film comprises a thermoplastic material.

22. The article of footwear of claim 16, wherein the polymer film comprises polyurethane.

23. The article of footwear of claim 16, wherein the polymer film extends outward from a perimeter of the sole structure a distance across the underfoot portion.

24. The article of footwear of claim 16, wherein the polymer film extends around a perimeter of the sole structure.

25. The article of footwear of claim 16, wherein the knitted component comprises a seam on the underfoot portion.

26. The article of footwear of claim 25, wherein the sole structure covers at least a portion of the seam.

27. The article of footwear of claim 25, wherein the polymer film covers at least a portion of the seam.

28. The article of footwear of claim 16, wherein the knitted component comprises a mesh.

29. The article of footwear of claim 16, wherein the article of footwear is a soccer shoe.

30. The article of footwear of claim 16, wherein the article of footwear is a football shoe.

31. An article of footwear, comprising:

a sole structure; and an upper secured to the sole structure, the upper comprising:

a knitted component comprising an underfoot portion; and a polyurethane skin bonded to an outer-facing surface of the knitted component, the polyurethane skin positioned between the outer-facing surface of the knitted component and the sole structure, and wherein a portion of the polyurethane skin is exposed on the underfoot portion in an area adjacent to the sole structure.

32. The article of footwear of claim 31, wherein the knitted component comprises an underfoot seam.

33. The article of footwear of claim 32, wherein the sole structure and the polyurethane skin extend over the underfoot seam.

34. The article of footwear of claim 31, wherein the polyurethane skin that is exposed extends onto a medial side of the upper and onto a lateral side of the upper.

35. The article of footwear of claim 31, wherein the polyurethane skin is joined to the outer-facing surface with an adhesive.

36. The article of footwear of claim 31, wherein the knitted component comprises a first portion and a second portion, the first portion being more elastic than the second portion.

37. The article of footwear of claim 36, wherein the first portion forms a throat area.

38. The article of footwear of claim 36, wherein the second portion is adjacent a biteline.

* * * * *